United States Patent [19]

Makino et al.

[11] Patent Number: 4,618,866

[45] Date of Patent: Oct. 21, 1986

[54] DUAL REFLECTOR ANTENNA SYSTEM

[75] Inventors: Shigeru Makino; Takashi Katagi; Shuji Urasaki; Shunichiro Kawabata; Yuji Kobayashi, all of Kanagawa, Japan

[73] Assignee: Mitsubishi Denki Kabushiki Kaisha, Tokyo, Japan

[21] Appl. No.: 546,048

[22] Filed: Oct. 27, 1983

[30] Foreign Application Priority Data

Nov. 17, 1982 [JP] Japan ..... 57-201525

[51] Int. Cl.[4] ..... H01Q 19/19

[52] U.S. Cl. ..... 343/779; 343/781 P; 343/840

[58] Field of Search ..... 343/781 R, 781 P, 781 CA, 343/840, 779

[56] References Cited

U.S. PATENT DOCUMENTS

| | | | |
|---|---|---|---|
| 2,665,383 | 1/1954 | Marié | 343/755 |
| 4,460,897 | 7/1984 | Cans | 343/781 P |
| 4,491,848 | 1/1985 | Dragone | 343/781 P |
| 4,503,435 | 3/1985 | Dragone | 343/781 P |

OTHER PUBLICATIONS

Beam Scanning Characteristics of Offset Gregorian Antennas–M. Akagawa et al., 1979 International Symposium Digest.

Elimination of Cross Polarization in Offset Dual-Reflector Antennas–Hirokazu Tanaka et al., Trans. IECE, vol. 58-B, No. 12.

*Primary Examiner*—Eli Lieberman

*Attorney, Agent, or Firm*—Bernard, Rothwell & Brown

[57] ABSTRACT

An antenna system in which primary radiators are disposed on the radiation side of beams from a main reflector and in opposition to a subreflector and in which the subreflector and the primary radiators are disposed in positions offset from beam blocking positions.

13 Claims, 5 Drawing Figures

DUAL REFLECTOR ANTENNA SYSTEM

FIELD OF THE INVENTION

The present invention relates to a dual reflector antenna system comprising a main reflector, a subreflector and a plurality of primary radiators or receivers and more particularly to an antenna system wherein a main reflector and a subreflector have a predetermined geometrical configurational relation to a plurality of primary radiators or receivers.

BACKGROUND OF THE INVENTION

Many studies have so far been made with respect to reflector antenna systems. For example, as to beam scanning characteristics of Gregorian antenna systems, a paper entitled "Beam Scanning Characteristics of Offset Gregorian Antennas" was made public by M. Akagawa et al in IEEE International Symposium Digest—Antennas & Prop in 1979. Further, as to the technique of eliminating cross polarization in offset dual reflector antenna systems, a report entitled "Elimination of Cross Polarization in Offset Dual-Reflector Antennas" is made by H. Tanaka et al in Trans IECE, Japan, '75/12 Vol. 58-B No. 12.

In addition to the antenna disclosed in the above literature, there are also known as conventional examples respectively shown in FIGS. 1, 2 and 3 as will be described below.

FIG. 1 schematically shows a partial section of conventional offset Cassegrain antennas used as dual reflector multi-beam antenna systems.

For the simplification of explanation, it is assumed that, as shown in FIG. 1, a main reflector 1 comprises a rotary parabolic mirror having a focus $F_1$ and a subreflector 2 comprises a rotary hyperbolic mirror having focuses $F_o$ and $F_1$. It is further, assumed that on the basis of a reference mirror which is determined geometro-optically when a primary receiver 3*a* is disposed on the focus $F_o$, primary radiators 3*b* and 3*c* are respectively disposed on points $F_o'$ and $F_o''$ in the vicinity of $F_o$ to scan electromagnetic wave beams. In this case it is apparent from the geometro-optically standpoint that one or both of the main reflector and the subreflector are required to be larger than the reference mirror. Therefore, the following description will be based on the assumption that the main reflector 1 is fixed to the reference mirror and only the subreflector 2 is made larger than the reference mirror.

As shown, an electromagnetic wave beam incident from the front, namely, from the right in the figure, is received by the primary receiver 3*a* located on the focus $F_o$ via the reflector 1 and the subreflector 2. Likewise, other electromagnetic wave beams incident from below and above the said electromagnetic wave beam are received respectively by the primary receivers 3*b* and 3*c* located on $F_o'$ and $F_o''$ via main reflector 1 and subreflector 2. In the antenna system having such an arrangement, in case the beam scanning angle is small, it is possible to minimize the generation of cross polarization component by selecting the arrangement of the reflector 1 and the subreflector 2 so as to satisfy the conditions for eliminating cross polarization, and it is possible to enlarge the focus length F to diameter D ratio (F/D) of offset parabola equivalent to the antenna system, as shown in FIG. 1, so that the characteristic deteriorations induced by beam scanning, such as a decrease in gain and increase in side lobes can be minimized.

However, in case the beam scanning angle is large, as shown in FIG. 3*a*, there may occur the case where part of an electromagnetic wave reflected by the reflector 1 passes without striking against the subreflector 2.

In view of the problem just mentioned, there has been proposed an antenna system whose arrangement is sectionally shown in FIG. 2(*b*). As shown in the figure, the subreflector 2 has a fairly large diameter and its reflective portions relating to the beaming directions are different from each other, thus deteriorating the utilization efficiency of the subreflector 2. Further, the positions $F_o$, $F_o'$ and $F_o''$ respectively of the radiators 3*a*, 3*b* and 3*c* disposed relating to the beaming directions are spaced apart from one another by a substantial distance, so that the configuration space of the primary radiators becomes fairly large.

FIG. 3 is a sectional view schematically showing the construction of a conventional offset Gregorian antenna used as a dual reflector multi-beam antenna.

As will be apparent from FIG. 3, the antenna system illustrated therein is advantageous over the antenna systems shown in FIGS. 2*a* and 2*b* in that the antenna construction can be rendered compact even in case the beam scanning angle is large. However, also in this case, the configuration space of the primary radiators becomes large because the positions $F_o$, $F_o'$ and $F_o''$ of the radiators 3*a*, 3*b* and 3*c* respectively are dispersed. Further, the curvature of the subreflector 2 becomes large, so even if the arrangement of the main and subreflectors 1 and 2 is so selected as to satisfy the conditions for eliminating cross polarization, its characteristics in beam scanning are fairly deteriorated and decrease in gain is conspicuous.

OBJECTS OF THE INVENTION

It is an object of the present invention to provide the antenna system which has an intensive arrangement of primary radiators or receivers to enable the system to be constructed compactly.

It is another object of the present invention to provide an antenna system which has minimized characteristic deteriorations caused by beam scanning such as deterioration of cross polarization characteristics and gain reduction.

SUMMARY OF THE INVENTION

The foregoing objects are achieved by the antenna system of the present invention in which primary radiators or receivers are disposed on the radiating or receivers side of beams from or to a main reflector with respect to a subreflector and in which the subreflector and the primary radiators or receivers are disposed in positions without blocking.

DETAILED DESCRIPTION OF A PREFERRED EMBODIMENT

Figure 2B:
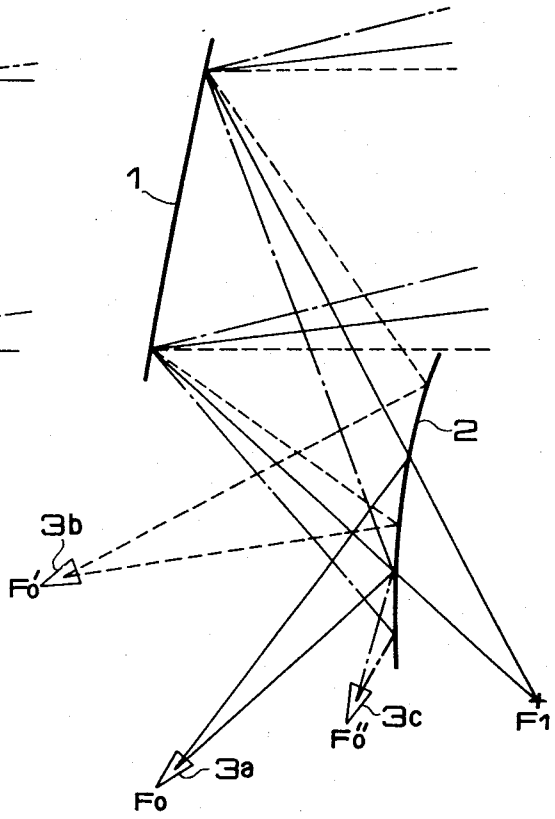
FIG. 2b (PRIOR ART)
FIGS. 2*a* and 2*b* are each illustrative of a relative positional relation between main and subreflectors in a conventional offset Cassegrain antenna.
Figure 2A:
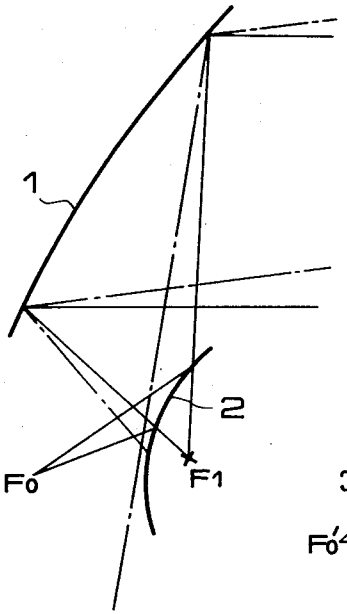
FIG. 2a (PRIOR ART)
Figure 1:
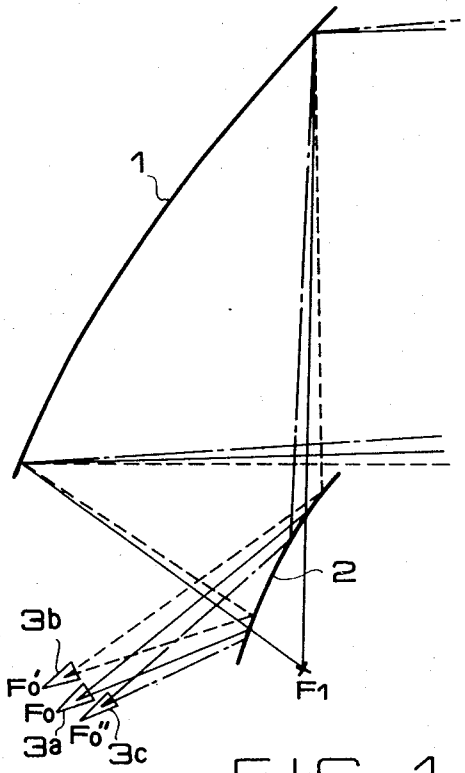
FIG. 1 (PRIOR ART)
FIG. 1 schematically illustrates a partial section of a conventional offset Cassegrain antenna.
Figure 3:
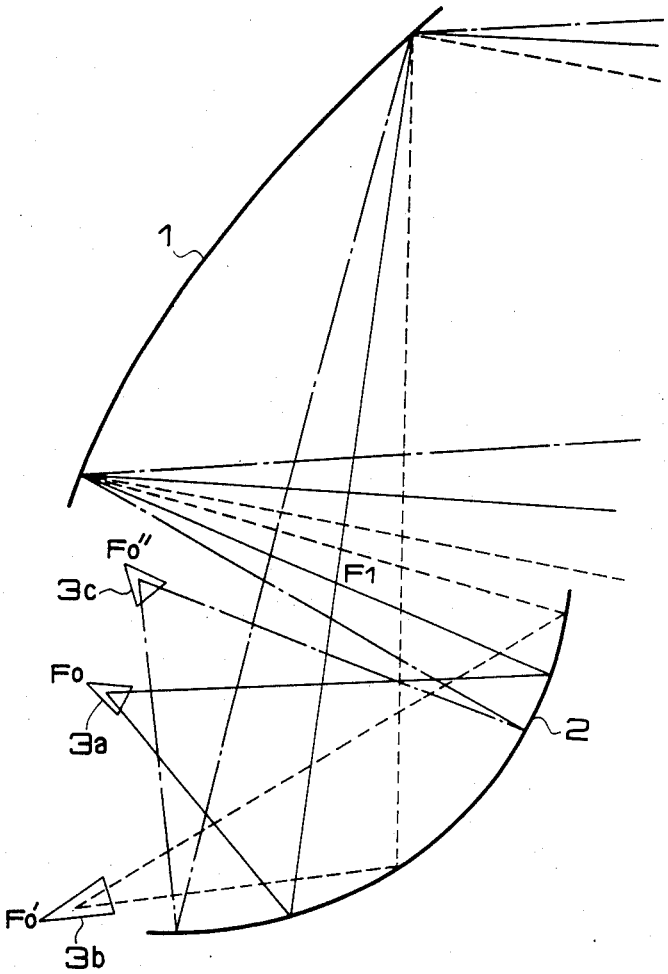
FIG. 3 (PRIOR ART)
FIG. 3 schematically illustrates a partial section of a conventional offset Gregorian antenna.
Figure 4:
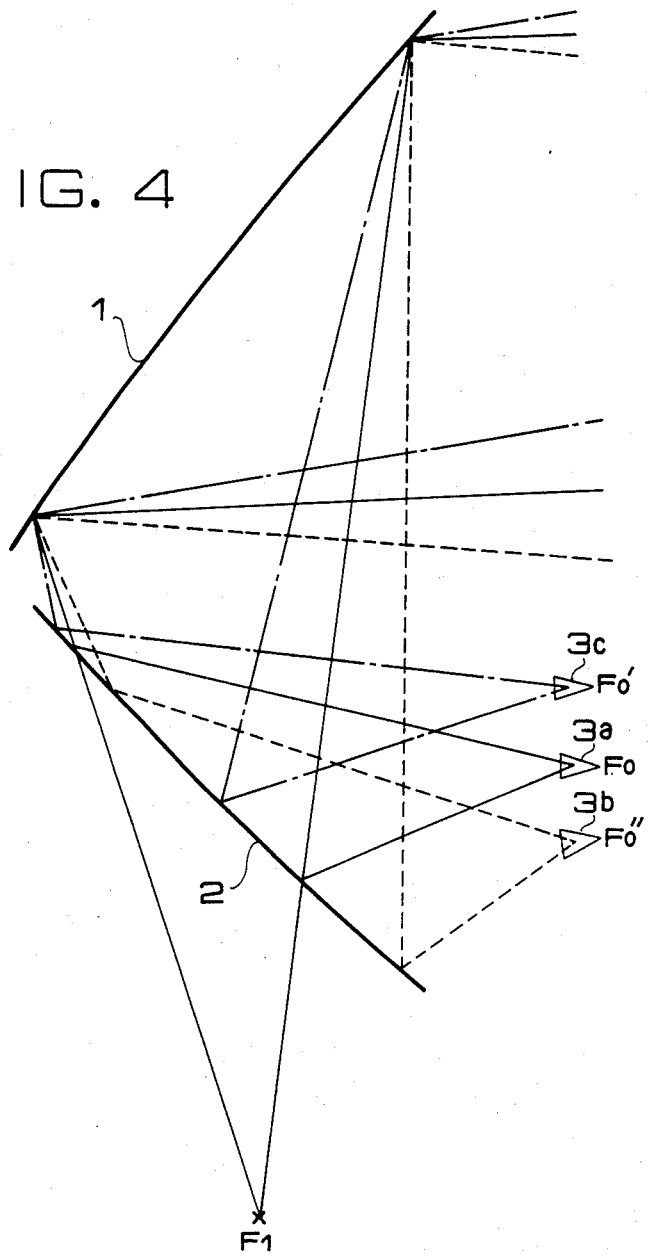
FIG. 4 illustrates a partial section of a principal portion of an antenna system embodying the present invention.

Referring now to FIG. 4, there is shown an arrangement of an antenna system having dual reflectors according to an embodiment of the present invention wherein the reflector 1 and subreflector 2 are provided, the former having the focus $F_1$ and the latter having the focuses $F_o$ and $F_1$ as indicated by the same reference numerals as previously described, and both being disposed so that the respective reflective surfaces face the right side. It is to be noted that the radiators 3*a*–3*c* are disposed on the beam radiating side of the reflector 1 in opposition to the subreflector 2.

In case the conditions for eliminating cross polarization are satisfied, the subreflector 2 is working as a concave mirror when viewed from the focus $F_o$.

In the antenna system having such a construction, the beam radiations from the radiators 3*a*–3*c* are effected respectively through the routes as indicated by solid line, broken line, and alternate long and short dash line.

The radiators 3*a*–3*c* are disposed on the beam radiating side of the reflector 1 with respect to the subreflector 2 so that not only the construction of the antenna becomes compact but also they can be disposed on substantially the same plane to each beam direction. Moreover, since the main and subreflectors 1 and 2 can take a shape close to a plane, it is possible to diminish characteristic deteriorations caused by beam scanning such as deterioration of the cross polarization level and gain reduction and the increase of sidelobe level caused by the aberration of the wavefront on the aperture.

Further, since spill-over components from the subreflector induced by beams emanating from the primary radiators are radiated to the side opposite to the main beam direction, the antenna system is improved in its wide angle radiation characteristics.

Although in the above embodiment the utilizing area of the main reflector was made common and the subreflector was assumed to be used so that its reflective portions relating to the beam scanning angle were different from each other, they may be set selectively in accordance with the beam scanning angle.

Further, although in the above embodiment the mirror was assumed to be quadric surface of revolution, it may be suitably modified.

Moreover, although the antenna system described in the above embodiment was assumed to be used as a multi-beam antenna, it may be used as an beam steerable antenna.

Further, although in the above embodiment the primary radiators were assumed to be used one for each beam, they may be substituted by cluster feeds.

Additionally, if the subreflector is made changeable in its position to adjust the beam direction, there will be obtained an antenna system having a higher degree of freedom. In this case, a conventional structure may be adopted as the displaceable structure of the subreflector 2.

Although in the above embodiment the antenna system has been described as a transmitting antenna, the antenna system, can be a receiving antenna system by substituting receivers for the radiators.

What is claimed is:

1. An antenna system comprising a main reflector having a concave reflective surface for reflecting incident electromagnetic wave beams to opposite antennas;

a subreflector having a concave reflective surface disposed in facing relationship with said main reflector for reflecting said electromagnetic wave beams to said main reflector;

primary radiators disposed in positions without blocking;

said main reflector and said subreflector being disposed on the same side with respect to said primary radiators; and said primary radiators being so positioned as to illuminate said subreflector to illuminate the same general area of said main reflector.

2. An antenna system according to claim 1, wherein said main reflector comprises a rotary parabolic mirror.

3. An antenna system according to claim 1, wherein said subreflector comprises a rotary hyperbolic mirror.

4. An antenna system according to claim 1, wherein each of said primary radiators is disposed in the vicinity of a focus of said subreflector.

5. An antenna system according to claim 1 or claim 4, wherein said primary radiators have apertures arranged on a single plane.

6. An antenna system according to claim 1 or claim 4, wherein said subreflector is changeably disposed for adjusting direction of said beams to be reflected thereby.

7. An antenna system according to claim 1 or claim 4, wherein said primary radiator comprises a cluster feed.

8. An antenna system comprising:

a main reflector having a concave reflective surface for reflecting incident electromagnetic wave beams from opposite antennas;

a subreflector having a concave reflective surface disposed in facing relationship with said main reflector for reflecting said electromagnetic wave beams reflected by said main reflector;

primary receivers disposed in positions without blocking;

said main reflector and said subreflector being disposed on the same side with respect to said primary receivers; and said primary receivers being so positioned as to be illuminated from said subreflector which is illuminated from the same general area of said main reflector.

9. An antenna system according to claim 8, wherein said main reflector comprises a rotary parabolic mirror.

10. An antenna system according to claim 8, wherein said subreflector comprising a rotary hyperbolic mirror.

11. An antenna system according to claim 8, wherein each of said primary receivers is disposed in the vicinity of a focus of said subreflector.

12. An antenna system according to claim 8 or claim 11, wherein said primary receives are arranged on a single plane.

13. An antenna system according to claim 8 or claim 11, wherein said subreflector is changeably disposed of adjusting direction of said beams to be reflected thereby.

* * * * *

UNITED STATES PATENT AND TRADEMARK OFFICE

CERTIFICATE OF CORRECTION

PATENT NO. : 4,618,866

DATED : October 21, 1986

INVENTOR(S) : Shigeru Makino et al.

It is certified that error appears in the above-identified patent and that said Letters Patent is hereby corrected as shown below:

Column 2, line 4, "3a" should be --2a--.

Column 4, line 58, "receives" should be --receivers--.

Column 4, line 61, "of" should be --for--.

Signed and Sealed this

Seventeenth Day of March, 1987

*Attest:*

DONALD J. QUIGG

*Attesting Officer*

*Commissioner of Patents and Trademarks*